US006698348B1

(12) United States Patent
Bloss

(10) Patent No.: US 6,698,348 B1
(45) Date of Patent: Mar. 2, 2004

(54) STENCIL CLIP FOR A CURB

(75) Inventor: Regan Brian Bloss, Brisbane (AU)

(73) Assignee: Edgetec Group Pty. Ltd., Queensland (AU)

( * ) Notice: Subject to any disclaimer, the term of this patent is extended or adjusted under 35 U.S.C. 154(b) by 0 days.

(21) Appl. No.: 10/316,271

(22) Filed: Dec. 11, 2002

(51) Int. Cl.[7] ..... B41F 17/30
(52) U.S. Cl. ..... 101/127; 101/129; 33/566
(58) Field of Search ..... 101/114, 127, 101/127.1, 129; 33/561.1, 561.2, 566, 565; 206/575; 434/87

(56) References Cited

U.S. PATENT DOCUMENTS 1,051,354 A * 1/1913 Strachan ..... 40/612
1,781,258 A * 11/1930 Walker ..... 101/128
2,347,022 A * 4/1944 Austin ..... 101/129
5,038,714 A 8/1991 Dye et al.
5,101,755 A * 4/1992 Barrett ..... 116/209
6,142,071 A 11/2000 Fexer
6,595,128 B2 * 7/2003 Parks ..... 101/127

* cited by examiner

*Primary Examiner*—Ren Yan
(74) *Attorney, Agent, or Firm*—Fay, Sharpe, Fagan, Minnich & McKee, LLP

(57) ABSTRACT

A stencil clip is used to apply a pattern onto an extruded concrete curb having a curved cross-sectional profile. The stencil clip is made of stiff but resiliently flexible sheet material pre-formed to match the cross-sectional profile of an upper portion of the curb, and may have at least one cut-out portion to define a decorative pattern or indicia. Alternatively, the stencil clip may be solid to serve as a blanking or masking stencil. The stencil has handle portions at its edges permitting the stencil to be clipped on and off the curb.

15 Claims, 4 Drawing Sheets

STENCIL CLIP FOR A CURB

This invention relates to a stencil clip for extruded concrete edging or similar curbing.

BACKGROUND ART

Edging for gardens and lawn, and similar forms of curbing, are now commonly made by mobile extruding machines which extrude concrete through a mould. Due to the extrusion process by which it is formed, the resultant curbing has a constant cross-sectional shape or profile determined by the sectional profile of the mould. Typically, at least the upper part of the curbing has a curved profile.

A decorative pattern may be applied to the extruded concrete curb or other edging to improve the aesthetics thereof, or alphanumeric indicia may be spray painted onto the curb, e.g. to indicate the manufacturer, property owner or street number. Due to the curved profile of the curb, it is difficult to apply decorative patterns or indicia consistently and accurately.

Masking tape and/or paper sheet stencils, such as the stencil described in U.S. Pat. No. 5,038,714, may be applied to the curb to define a pattern corresponding to the desired decorative pattern. The curb is sprayed through the stencil, which is then removed to leave the decorative pattern. The stencils are typically made of thin paper or plastic sheet, and tear easily. Such known stencils are normally discarded as they are designed for single use only. Moreover, the known stencils are intended for use on flat surfaces, such as concrete paths or driveways, and the application of such stencils to a curved curb surface is both difficult and tedious.

U.S. Pat. No. 6,142,071 describes a re-usable stencil kit for the application of painted address characters to a street curb. However, the stencil kit is designed for application to a flat planar surface, and is not particularly suited for curved surfaces. Furthermore, the application of the stencil of U.S. Pat. No. 6,142,071 is time consuming.

It is an object of this invention to provide an improved stencil for curbing, particularly extruded concrete edging having a curved profile.

SUMMARY OF THE INVENTION

In one broad form, the invention comprises a stencil for an extruded concrete curb or similar edging having a constant cross-sectional shape along a length thereof, the stencil being pre-formed from a resiliently flexible sheet and having a constant cross-sectional shape at rest which substantially matches the cross-sectional profile of an upper portion of the curb, the stencil having side portions which can flex outwardly to permit the stencil to be clipped on and off the curb.

Preferably, the sheet material is spring steel sheet.

Advantageously, the stencil has edge portions along opposite sides thereof, the edge portions extending generally laterally outwardly. The edge portions serve as handles permitting the side walls to be pulled slightly apart when the stencil is being clipped onto the curb, or removed therefrom. The edge portions may curve slightly upwardly at their distal ends, to facilitate grasping.

The stencil may have at least one cut-out portion in an upper portion thereof. The cut-out portion typically defines a decorative shape of a coating to be applied to the curb. Alternatively, the stencil may be a solid clip which serves as a blanking or masking stencil.

In order that the invention may be more fully understood and put into practice, preferred embodiments thereof will now be described with reference to the accompanying drawings.

DESCRIPTION OF PREFERRED EMBODIMENTS

Figure 1:
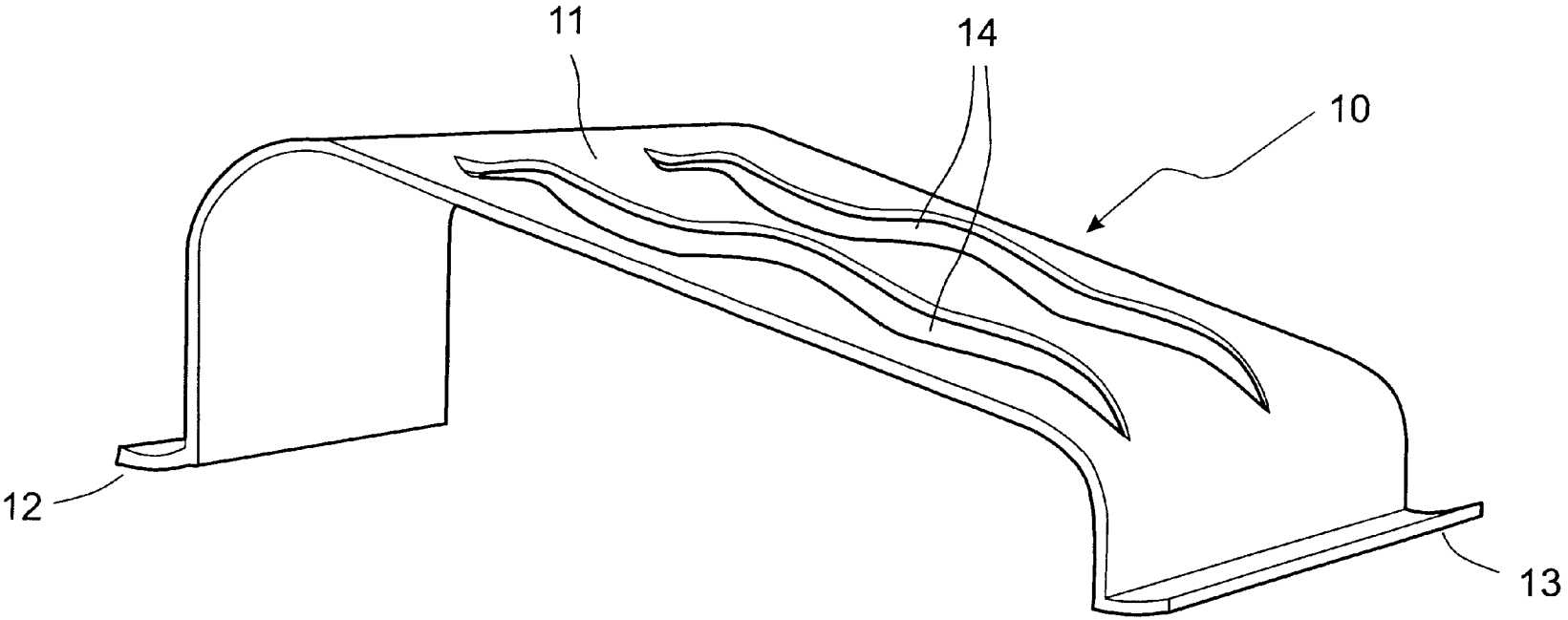
FIG. 1 is a perspective view of a stencil according to one embodiment of the invention.

As shown in FIG. 1, a stencil clip 10 is formed from a thin sheet 11 which is bent or curved to form a clip having a desired sectional profile. In the illustrated embodiment, the sectional profile comprises a generally flat sloping top section with curved transitions to opposite end walls. The stencil clip 10 is of constant cross-section, and is shaped to match a particular curb profile, as described below.

The stencil 10 also has a pair of edge portions 12, 13 along opposite sides thereof, which extend laterally outwardly and serve as handles. The edge portions 12, 13 are slightly curved upwardly at their distal ends to facilitate grasping.

Cut-out portions 14 are formed in the upper part of the stencil 10 to define a decorative pattern, alphanumeric indicia, or other design.

The stencil 10 is made from stiff but resiliently flexible material, such as spring steel sheet. The stencil 10 is slightly flexible, but has a memory or rest shape as shown in the drawing. That is, the stencil can be slightly deformed or otherwise bent out of shape to some degree, but upon removal of the bending or deforming forces, the stencil will resume its shape.

Figure 2:
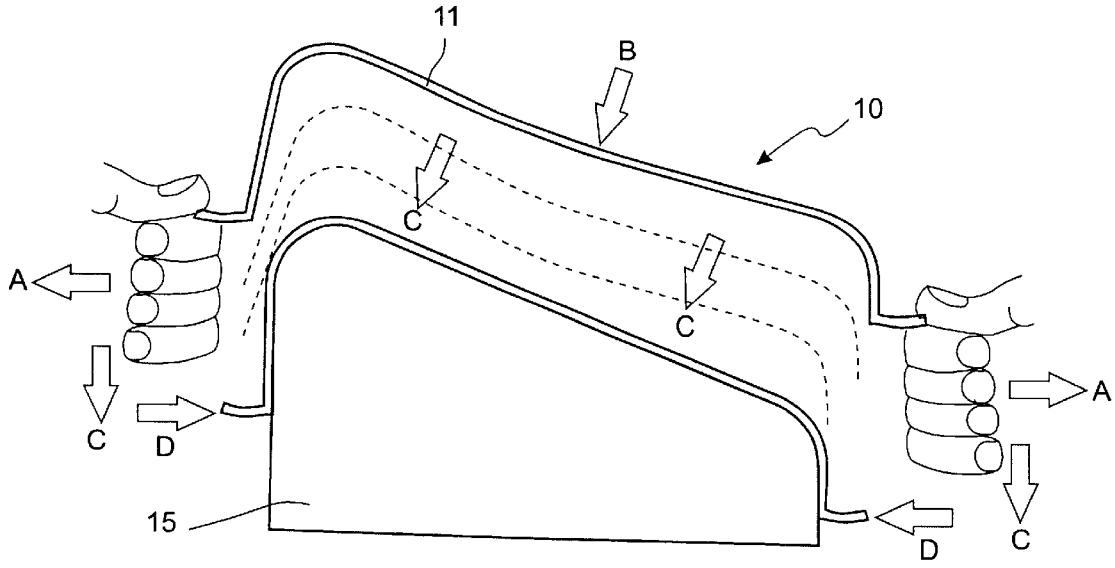
FIG. 2 is a schematic sectional view illustrating the application of the stencil to a curb.

The application of the stencil 10 to a curb 15 is illustrated in FIG. 2. The curb 15 is typically newly extruded concrete edging for lawns, gardens and the like, and the stencil clip 10 is shaped in cross-section to match the cross-sectional profile of the upper part of the curb. Preferably, the stencil 10 has a slightly narrower cross-sectional width than the corresponding curb 15. When applying the stencil 10, the end portions 12, 13 are grasped manually and pulled outwardly (in the opposite directions marked A in FIG. 2), causing the top middle portion of the stencil sheet 11 to flex slightly inwardly (direction B). The stencil 10 is then lowered onto the curb 15 (direction C), whereupon the edge portions 12, 13 are released. Due to the resiliently flexible nature of the spring steel sheet used to form the stencil 10, the edge portions 12, 13 spring back to the rest shape, thereby grasping the sides of the curb 15 and holding the stencil 10 onto the curb.

The stencil 10 thereby clips onto the curb and is self-retained thereon. The end portions 12, 13 apply sufficient pressure to the wet surface of a newly formed curb so as to retain the stencil thereon, but without distorting the surface of the curb.

Alternatively, if the curb has set hard, the stencil clip 10 may simply be pushed onto the curb 15 from above.

Once the stencil clip has been clipped on, a top coat of cementious material or other coating is sprayed over the curb 15. After the application of this material, the stencil clip 10 is removed, leaving the pattern defined by the cut-out portions 14 of the stencil clip.

Figure 3:
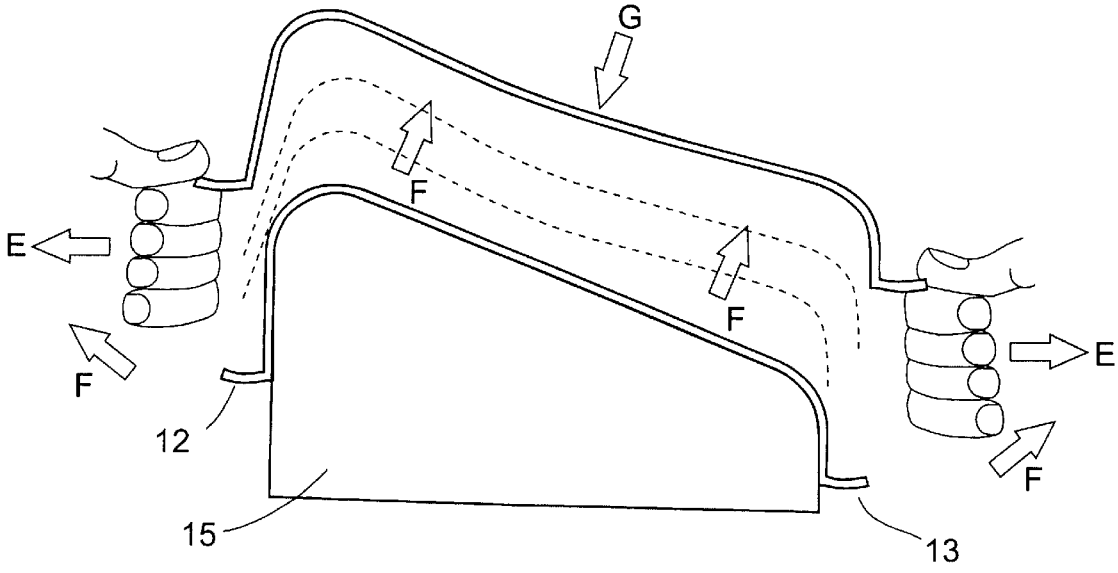
FIG. 3 is a schematic sectional view illustrating the removal of the stencil from a curve.

FIG. 3 illustrates a procedure for removing the stencil clip without distorting the curb 15. The edge portions 12, 13 are pulled outwardly (in respective directions E) while lifting the stencil 10 off the curb 15 (direction F). The middle portion of the stencil 10 flexes slightly (direction G) in response to the edge portions 12, 13 being pulled outwardly and upwardly. Alternatively, the stencil may be pulled off from above, particularly if the curb is set hard.

The stencil of this invention allows decorative patterns and/or alphanumeric indicia to be applied quickly and easily to extruded concrete edging, even though the edging has a curved upper surface. Moreover, the stencil clip 10 can be used repeatedly along the length of a curb in a rapid manner. The stencil is applied, sprayed and then removed in a quick succession of steps, which are repeated as required. The robust nature of the spring steel stencil permits it to be used repeatedly. The stencil thereby simplifies and expedites the process for applying a pattern to a curved curb.

Figure 4:
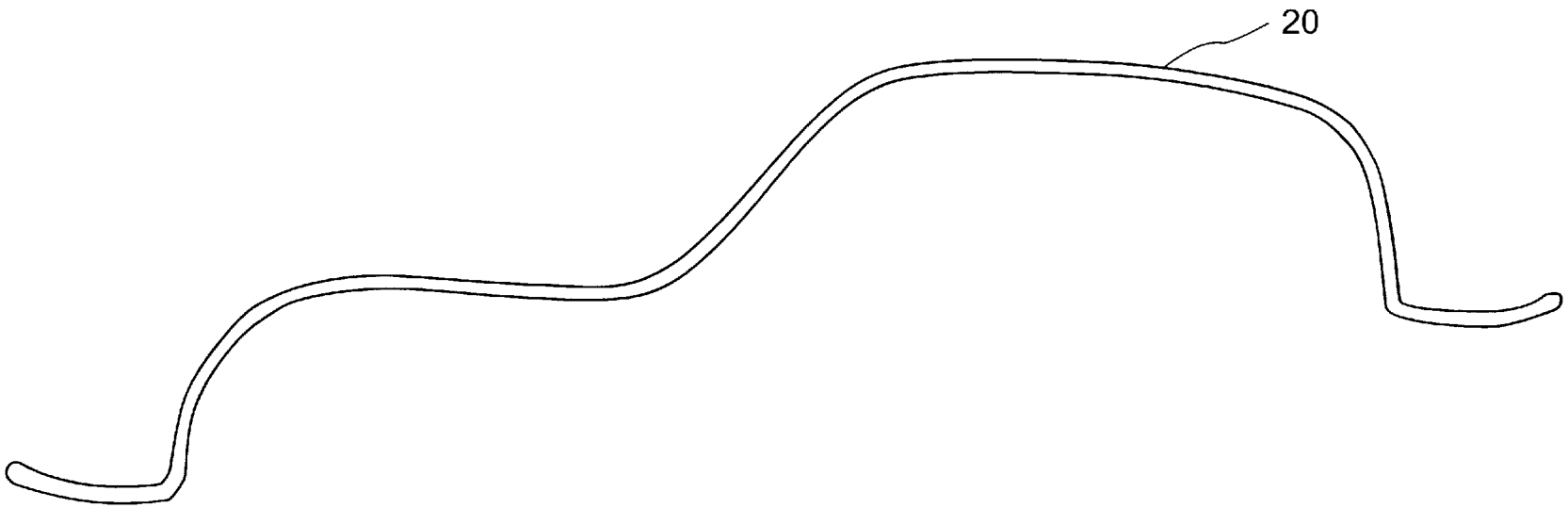
FIG. 4 is a cross-sectional view of a stencil according to another embodiment.

FIG. 4 illustrates a stencil 20 according to another embodiment of the invention, having a sectional shape adapted to match the profile of a curved curb surface having two levels.

Figure 5:
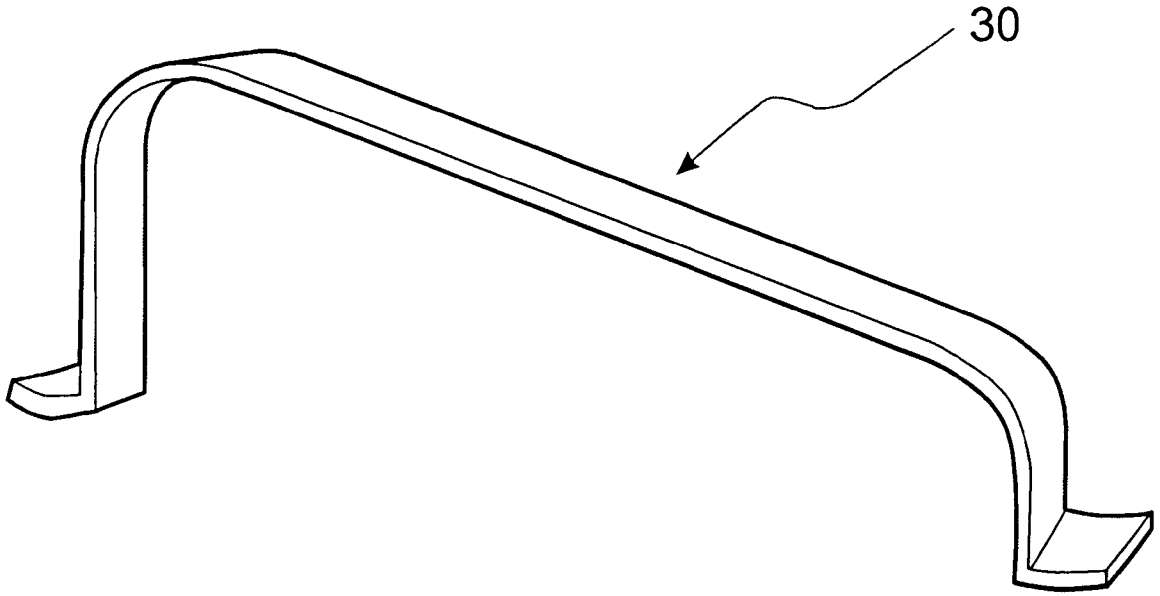
FIG. 5 is a perspective view of a stencil according to yet another embodiment of the invention.

FIG. 5 illustrates yet another embodiment of this invention. The stencil 30 illustrated in FIG. 5 is a spring clip formed from a relatively thin strip of resilient material, such as spring steel. Like the stencil 10 of FIG. 1, the stencil clip 30 is configured to match the profile of a curb to which it is intended to be applied. However, the stencil clip 30 is solid, i.e. it does not have any apertures or cut-out portions. The stencil clip 30 is intended to be used as a blanking or masking stencil.

In use, after a concrete curb has been extruded, the stencil clip 30 is clipped onto the curb (as described above), and a coating is applied over the stencil clip and surrounding portions of the curb. Typically, the coating is a cementitious clay-coloured material resembling a brick or similar ceramic surface. The clip 30 is then removed to leave a bare concrete transverse strip on the curb, simulating a mortar joint between clay blocks.

The above process is repeated progressively along the length of the curb at spaced intervals, so that the coated curb simulates a series of clay blocks laid end-to-end, with mortar joints between the blocks.

The foregoing describes only some embodiments of the invention, and modifications which are obvious to those skilled in the art may be made thereto without departing from the scope of the invention, as defined in the following claims.

For example, instead of spring steel, the stencil 10 may be made of resiliently flexible plastics material. Furthermore, the stencil may have any desired suitable length.

What is claimed is:

1. A stencil for an extruded concrete curb or similar having a constant cross-sectional shape along a length thereof, the stencil being pre-formed from resiliently flexible sheet material and having a constant cross-sectional shape at rest which substantially matches the cross-sectional profile of an upper portion of the curb, the stencil having side portions which can flex outwardly to permit the stencil to be clipped on and off the curb.

2. A stencil as claimed in claim 1, wherein the sheet material is spring steel sheet.

3. A stencil as claimed in claim 1, further comprising edge portions along opposite sides thereof, the edge portions extending generally laterally outwardly.

4. A stencil as claimed in claim 3, wherein the edge portions curve upwardly at their distal ends.

5. A stencil as claimed in claim 3, wherein the sheet material is spring steel sheet.

6. A stencil as claimed in claim 5, further having at least one cut-out portion in an upper portion thereof.

7. A stencil as claimed in claim 6, wherein the cut-out portion defines a decorative shape.

8. A stencil as claimed in claim 5, wherein the stencil is a spring clip formed from a non-apertured strip of sheet material.

9. A stencil as claimed in claim 1, wherein the sheet material is a plastics material.

10. A stencil as claimed in claim 1, wherein the stencil has an internal width at rest which is slightly less than the external width of the curb, so that the stencil is frictionally retained on the curb.

11. A stencil for an extruded concrete curb or like edging having a constant cross-sectional shape along a length thereof, the stencil comprising a spring steel clip configured to match the cross-sectional profile of an upper portion of the curb, the spring steel clip having side walls adapted to resiliently grasp the curb therebetween when the stencil is clipped onto the curb, and handle portions extending laterally from the side walls to permit the side walls of the stencil to be pulled off the curb.

12. A stencil as claimed in claim 11 further having at least one cut-out portion in an upper portion of the clip.

13. A stencil as claimed in claim 11 wherein the clip is formed from a non-apertured strip of sheet material.

14. A method of applying the stencil defined in claim 11 to an extruded concrete curb or similar edging having a constant cross-sectional shape along a length thereof, comprising the steps of:

(a) grasping the handle portions and pulling them slightly apart while applying the stencil to the curb, (b) releasing the handle portions to enable the stencil to clip onto the curb, (c) applying a coating over the stencil and surrounding portions of the curb, and (d) removing the stencil by pulling the handle portions outwardly and lifting the stencil off the curb.

15. A method as claimed in claim 14, further comprising repeating steps (a) to (d) progressively at spaced intervals along the curb.

* * * * *